US005340225A

United States Patent [19]

Chevassus

[11] Patent Number: 5,340,225

[45] Date of Patent: Aug. 23, 1994

[54] CASE FOR STICKS OF PASTY COSMETIC, PHARMACEUTICAL OR LIKE PRODUCTS

[75] Inventor: Alain Chevassus, Sceaux, France

[73] Assignee: Techpack International - TPI, France

[21] Appl. No.: 982,866

[22] Filed: Nov. 30, 1992

[30] Foreign Application Priority Data

Nov. 29, 1991 [FR] France ..... 91 14838

[51] Int. Cl.[5] ..... A45D 40/06

[52] U.S. Cl. ..... 401/78; 401/86

[58] Field of Search ..... 401/68, 78, 98, 75, 401/86, 79

[56] References Cited

U.S. PATENT DOCUMENTS 4,505,607 3/1985 Sugiyama ..... 401/78
4,666,324 5/1987 Oses ..... 401/131
4,884,912 12/1989 Gueret ..... 401/78

FOREIGN PATENT DOCUMENTS 2751233 5/1979 Fed. Rep. of Germany .
8528786 1/1986 Fed. Rep. of Germany .
9106412 8/1991 Fed. Rep. of Germany .
2161340 7/1973 France .
2502471 10/1982 France .
2165220 4/1986 United Kingdom .

*Primary Examiner*—Danton D. DeMille
*Attorney, Agent, or Firm*—Steinberg Raskin and Davidson

[57] ABSTRACT

A case for pasty cosmetic, pharmaceutical or like products comprising an outer casing co-operating with a coaxial inner casing in which is axially slidably mounted a cup carrying a lipstick so that the relative rotation of both casings results in an axial displacement of said cup, the inner casing being made fast to a base through the medium of a tube provided in the bottom wall of the base comprising cogging elements joined by ring portions which comprise on their outer faces ribs for co-operation with flutes formed on the inner surface of a skirt provided at the lower part of the inner casing, this device being applicable to the fastening of an inner casing upon a base within a lipstick case.

12 Claims, 2 Drawing Sheets

CASE FOR STICKS OF PASTY COSMETIC, PHARMACEUTICAL OR LIKE PRODUCTS

BACKGROUND OF THE INVENTION

The present invention relates to a case or container for sticks of pasty cosmetic, pharmaceutical or like products.

There are known cases for lipsticks for instance which comprise a mechanism mainly including an outer tubular casing comprising an inner helical threading co-operating with an inner tubular casing mounted inside of this outer casing and in which is sliding a cup supporting the lipstick, so as to entail the axial displacement of the cup through relative rotation of both casings. This mechanism is generally fastened in a removable or final manner with the lower portion (or base) of the inner casing onto a base of generally tubular form and comprising a bottom wall.

This fastening connection is carried out in a known fashion through the medium of a funnel provided in in a bottom wall of the base of the inner casing, on which is tightly fitted a tubular fitting part made fast to the said base. Now this kind of fastening exhibits many inconveniences due in particular to difficulties of positioning of the mechanism when the bases of the "lipsticks" are of square or hexagonal shapes, to the lack of behaviour of the whole and above all to the appearence of cracks in the base of the inner casing due to the existence of substantial radial stresses. Moreover the achieved locking in rotation is not always satisfactory especially in the case of use of fatty products.

Furthermore there is also known a kind of fastening of the aforesaid inner casing onto the base through non-tight fitting of the aforesaid funnel upon the aforesaid tubular fitting part of the base. The latter is then provided on its upper circumference with cogging dogs allowing the funnel of the inner casing to be retained between these same dogs and a weight placed in the bottom wall of the said base. The interlocking in rotation of both parts is then provided through the agency of cogs referred to as "clutch teeth" formed on the upper circumference of the funnel co-operating with the lower surface of the said dogs. Now this solution does not allow to obtain a sufficient quality of blocking in rotation.

OBJECTS AND SUMMARY OF THE INVENTION

The present invention solves these problems and provides a case or container for sticks of pasty cosmetic, pharmaceutical or like products in which the fastening of the inner casing on the base is carried out in a reliable and accurate manner.

For that purpose the subject of the present invention is a case for sticks of pasty cosmetic, pharmaceutical or like products of the type comprising a mechanism in which an outer casing co-operates with a coaxial inner casing and wherein is mounted in axially sliding relationship a cup supporting a lipstick so that the relative rotation of both casings results in an axial displacement of the said cup, the said inner casing being made fast in rotation and axially to a base, the aforesaid axial fastening being carried out through the medium of a skirt formed in the bottom wall of the inner casing engaging in snapping relationship about a split tube made fast to the base , the said skirt being retained by cogging elements provided on the upper portion of the said tube and bearing upon a stop located on the bottom wall of the said base, this case being characterized in that aforesaid cogging elements consist of a lug topped by a dog formed in the extension of the inner circumference of the tube, which dog extends radially beyond the outer surface of the said lugs in order to form the aforesaid stop, the said cogging elements being connected by crown or ring portions comprising at least one rib axially projecting from their outer face and co-operating with flutes or serrations formed on the inner surface of the skirt so as to provide the aforesaid blocking in rotation, in the position in which the skirt is retained by the dogs, and in that the said dogs comprise a flat top face, an adjacent face inclined substantially at 45° with respect to that flat face and a bulged bottom face connected to the outer surface of the aforesaid lug.

According to a particular embodiment of the invention, the aforesaid ribs exhibit a substantially tetrahedral shape.

According to a particular characterizing feature, the aforesaid crown or ring portions exhibit a height substantially equal to one half of the height of the aforesaid cogging elements.

According to a further characterizing feature of the invention the cogging elements form set-back portions with respect to the outer surface of the ring portions.

It should also be noted that the cogging elements are in a number of four, each ring portion comprising three ribs.

BRIEF DESCRIPTION OF THE DRAWINGS

The invention will be better understood and further objects, characterizing features, details and advantages thereof will appear better as the following explanatory description proceeds with reference to the accompanying diagrammatic drawings given by way of non-limiting example only and in which.

DETAILED DESCRIPTION OF THE INVENTION

Figure 1:
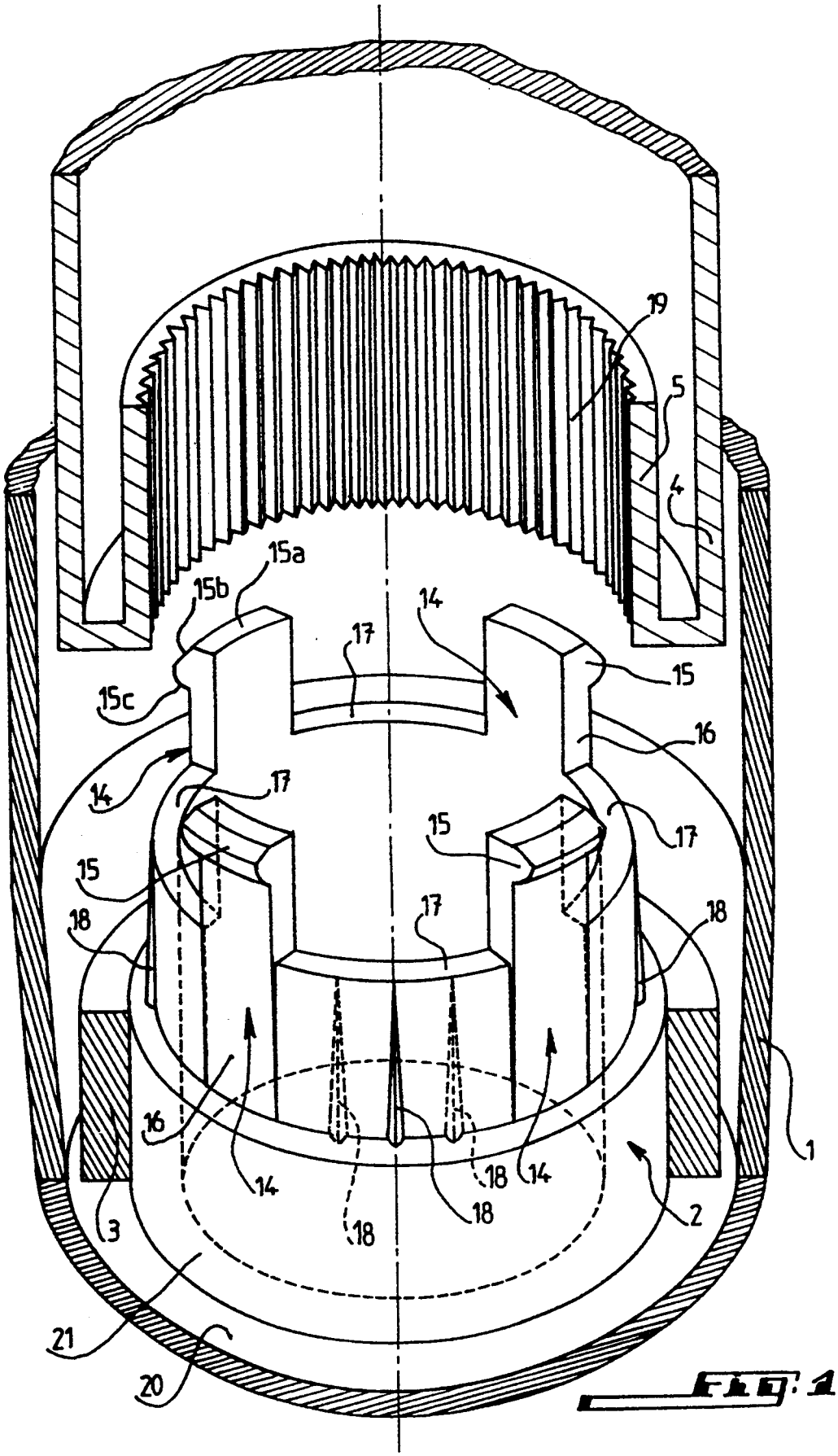
FIG. 1 is a partial exploded perspective view illustrating the mechanism for fastening the inner casing of a lipstick case or container onto a base.

On the figures, there is seen a case E for a lipstick consisting in a known manner of a mechanism including an outer casing 6 enclosed in a sleeve 7 and on the inner surface of which has been formed a helical groove 11, the said outer casing 6 being fitted around an inner casing 4 comprising a base C upon which the outer casing 6 is bearing. This inner casing 4 is provided with two diametrally opposite longitudinal grooves 12 adapted to receive two also diametrally opposite studs 9 made fast to a cup 8 carrying the lipstick and mounted in axially sliding relationship inside of the inner casing 4. The said longitudinal grooves 12 comprise at their lower and upper ends, respectively, recesses adapted to receive the same studs at the end of the stroke of the cup 8 whereas this cup 8 is provided with reinforcing ribs 13 and with elements 10 with a braking function.

This mechanism is adapted to be secured upon a base of tubular shape 1 and comprising a bottom 20 upon which is placed a weight 3 adapted to improve the stability of the whole in the vertical position.

In order to provide this fastening and as more particularly seen on FIG. 1 the inner casing 4 comprises in its bottom wall a skirt 5 exhibiting a fluted, corrugated or serrated inner surface 19 whereas the aforesaid base 1 comprises a tube 2 formed of a first ring 21 made fast to the bottom wall 20 of the base I and comprising at its top portion cogging elements 14 projecting towards the upper portion of the whole and connected by ring portions 17, the said elements 14 and the ring portions 17 being located in the aligned or registering extension of the inner surface of the aforesaid first ring 2. This first ring 2 extends radially beyond outer surfaces of the cogging elements 14 so as to form a bearing surface for the inner casing 4. These cogging elements 14 consist each one of a lug 16 the upper portion of which is formed of a dog, catch or like snug. This dog 15 comprises a flat top face 15*a*, a face 15*b* sloping at 45° with respect to this face 15*a* and a bulged bottom face 15*c* connected to the outer surface of the lug 16 whereas this lug 16 extends sligthly radially beyond the outer surface of the aforesaid ring portions 17.

These ring portions connecting the cogging elements 14 are extending in height up to about one half of the height of these cogging elements 14 and comprise on their outer faces ribs 18 of substantially tretrahedral shape.

It should be pointed out that the tube 2 consisting of the first ring 21, the cogging elements 14 and the ring portions 17 are made from an elastically deformable material.

Figure 2:
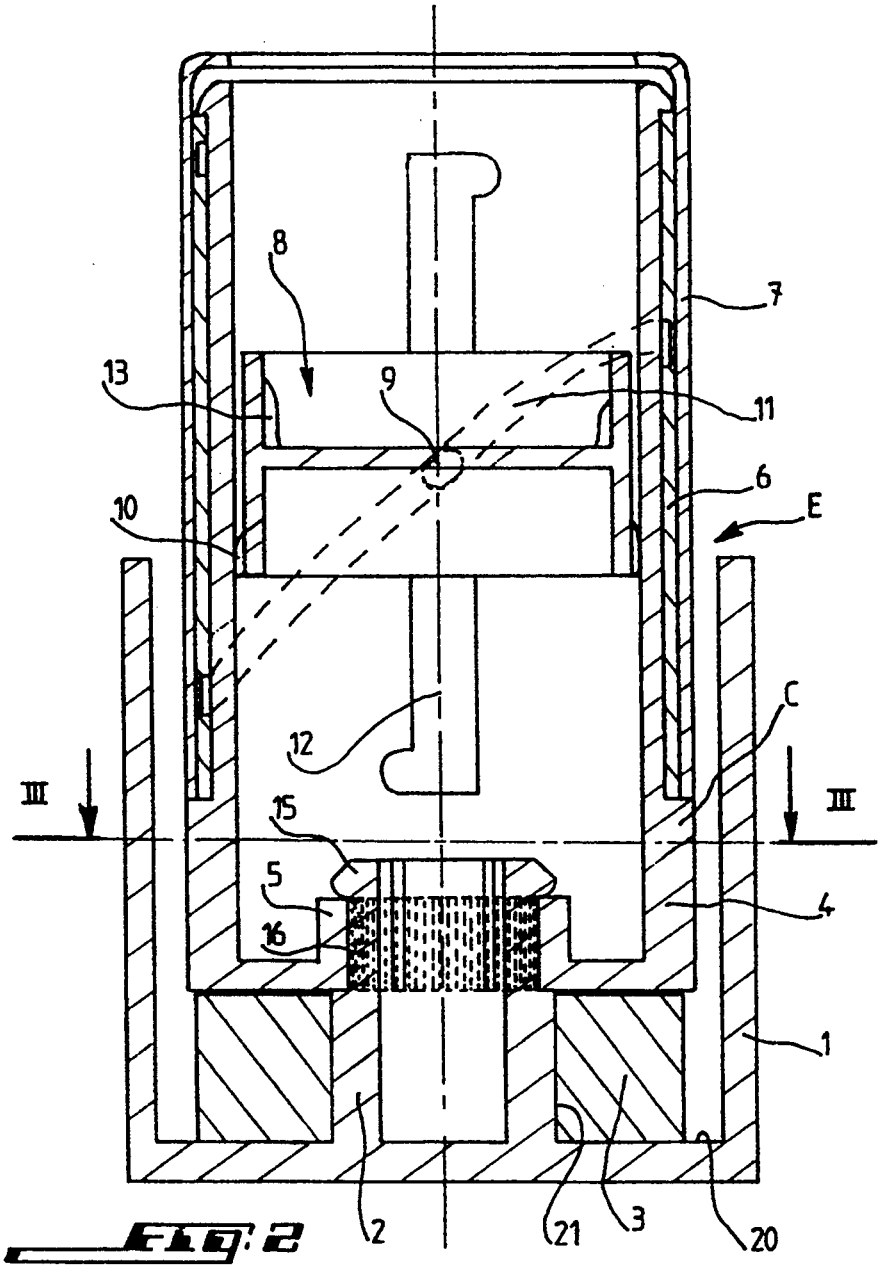
FIG. 2 is a view in axial section of the case or container of the foregoing figure in the position of the casing fastened upon the base.
Figure 3:
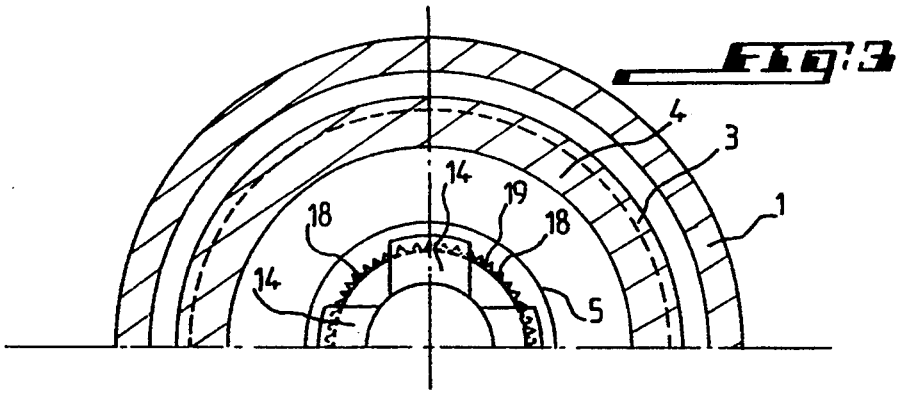
FIG. 3 is a view in radial section taken upon the line III—III of FIG. 2.

In operation and as more particularly shown on FIGS. 2 and 3, the mechanism is secured upon the base 1 through cogging engagement of the inner casing 4 with and about the tube 21 of the base 1 owing to the radial contraction inwards of the cogging elements 14, which in view of their shape are providing for the automatic centering of the mechanism with respect to the base 1 until the upper portion of the aforesaid skirt 5 be brought to the level of the lower portion of the aforesaid dogs 15 thereby resulting in the return of the said dogs into the initial position and until the lower portion of this skirt 5 is bearing upon the said first ring 2. In this position the ribs 18 of the ring portions 17 are co-operating with the flutes, corrugations or serrations 19 of the skirt 5 for providing a satisfactory interlocking of both parts for binding them together in relative rotation.

It should also be pointed out that the set-back portions provided by the cogging elements 14 are participating in this interlocking.

It should be noted that the flexibility of the whole advantageously avoids the radial stresses undergone by the parts or members of plastics material in the case of a force-fitting wherefrom it results a better behaviour with time and the removal of the risk or hazard of cracking.

There has thus been provided owing to the invention a case for a stick of pasty products allowing an accurate and reliable fastening of the inner casing upon the base.

The invention is of course not at all limited to the embodiment described and illustrated which has been given by way of example only.

On the contrary the invention comprises all the technical equivalents of the means described as well as their combinations if the latter are carried out according to its gist and within the scope of the appended claims.

What is claimed is:

1. A case for sticks of pasty cosmetic, pharmaceutical or like products, comprising a mechanism having an outer casing and an inner casing mounted coaxially and relatively rotatably with one another, a cup carrying said stick of pasty products and mounted axially movably in the inner casing through means co-operating with the outer casing when said outer casing is rotated, a tubular base having an open end and an end opposite thereto which is closed by a bottom wall, a tubular coaxial element being provided on said bottom wall extending towards said open end and an annular space being formed between said base and said coaxial tubular element, said inner casing having a tubular outer wall, a coaxial inner skirt and a perpendicular annular bottom wall connecting one end of said outer wall and one end of said skirt, said inner casing being adapted to be coaxially assembled to said base by axially engaging said skirt around said tubular coaxial element, cogging means being provided which are carried by the free end opposite to said annular bottom wall of said tubular coaxial element and comprising a plurality of elements each formed by a dog protruding radially towards the wall of the base and adapted to be engaged in abutment relationship on the upper face of said skirt to axially lock said inner casing in its position mounted around said tubular coaxial element when engaged in said annular space, said cogging means comprising a plurality of cogging elements each consisting of a resiliently perpendicularly flexible lug extending axially from said free tubular element end angularly located around the axis thereof and carrying at its end one of said dogs extending radially beyond the outer surface of the lug, and that the inner face of said skirt and the outer face of said tubular element comprise means co-operating with one another and adapted to rotatively secure said tubular end and said skirt, when the latter is axially engaged around said tubular element.

2. Case according to claim 1, wherein the inner surface of said skirt comprises axially extending flutes and the external face of said tubular coaxial element comprises at least one axial rib adapted to co-operate with said flutes for rotatably securing said skirt and said tubular element.

3. Case according to claim 2, wherein said rib has a substantially tetrahedral shape having a height and a width increasing towards the bottom wall of the case.

4. Case according to claim 1, wherein the lower portions of said resilient lugs are connected by ring portions and the outer faces of said lugs and said ring portions are radially shifted towards the axis of the base with respect to the outer surface of said coaxial tubular element so as to form a bearing surface for the annular bottom wall of said inner casing, each ring portion carrying on its outer surface at least one rib.

5. Case according to claim 1, wherein each of said dogs comprises a flat top face, an adjacent face sloping substantially at about 45° with respect to said flat face and a bulged bottom face connected to the outer face of the lug carrying said dog.

6. Case according to claim 4, wherein said ring portions have a height substantially equal to one half of the length of said lugs.

7. Case according to claim 1, wherein four lugs are provided and each ring portion comprises three ribs.

8. A case for sticks of pasty cosmetic, pharmaceutical or like products of the type comprising a mechanism in which an outer casing co-operates with a coaxial inner casing in which is axially slidably mounted a cup carrying a lipstick so that the relative rotation of both casings results in an axial displacement of said cup, said inner casing being made fast in rotation and axially to a base, said axial fastening being provided through the medium of a shirt formed in the bottom wall of the inner casing engaging in cogging relationship with and about a tube made fast to the base, said skirt being retained by cogging elements provided on the upper portion of said tube, and bearing upon a bearing surface located on the bottom wall of said base, wherein the improvement consists in that said cogging elements consist each one of a lug topped by a dog provided in the registering extension of the inner circumference of the tube, which tube extends radially beyond the outer surface of said lugs in order to form said bearing surface, said cogging elements being connected by ring portions comprising at least one rib projecting axially from their outer faces and co-operating with flutes formed on the inner surface of said skirt so as to make fast in rotation said inner casing, and said base in the position wherein the skirt is retained by the dogs and in that said dogs comprise each one a flat top face, an adjacent face sloping substantially at 45° with respect to that flat face and a bulged bottom face connected to the outer face of said lug.

9. A case according to claim 8, wherein said at least one rib exhibits each one a substantially tetrahedral shape.

10. A case according to claim 8, wherein said ring portions have a height substantially equal to one half of the height of said cogging elements.

11. A case according to claim 8, wherein the cogging elements form set-back portions with respect to the outer surfaces of said ring portions.

12. A case according to claim 8, wherein said cogging elements are in a number of four, each ring portion comprising three ribs.

* * * * *